US011071879B2

(12) United States Patent
Chabod et al.

(10) Patent No.: US 11,071,879 B2
(45) Date of Patent: Jul. 27, 2021

(54) SELF-LOCKING DESCENDER WITH DISENGAGEABLE HANDLE

(71) Applicant: ZEDEL, Crolles (FR)

(72) Inventors: Pierre-Olivier Chabod, Pontcharra (FR); Christophe Quillard, Eybens (FR); Aurélie Bergez, Gieres (FR)

(73) Assignee: ZEDEL, Crolles (FR)

( * ) Notice: Subject to any disclaimer, the term of this patent is extended or adjusted under 35 U.S.C. 154(b) by 300 days.

(21) Appl. No.: 16/381,152

(22) Filed: Apr. 11, 2019

(65) Prior Publication Data

US 2019/0314651 A1 Oct. 17, 2019

(30) Foreign Application Priority Data

Apr. 11, 2018 (FR) ..... 1853186

(51) Int. Cl.
*A62B 1/14* (2006.01)

(52) U.S. Cl.
CPC ..... *A62B 1/14* (2013.01)

(58) Field of Classification Search
CPC .... A62B 1/00; A62B 1/14; A62B 1/10; A62B 1/06
See application file for complete search history.

(56) References Cited

U.S. PATENT DOCUMENTS 5,577,576 A * 11/1996 Petzl ..... A62B 1/14 188/65.4
9,623,269 B2 * 4/2017 Oddou ..... A62B 1/14
10,035,028 B1 * 7/2018 Siegel ..... A62B 1/06
10,092,781 B2 * 10/2018 Malcolm ..... A62B 1/14
2007/0215411 A1 * 9/2007 Petzl ..... A62B 1/14 182/193
2009/0026023 A1 * 1/2009 Petzl ..... A62B 1/14 188/65.4
2011/0073417 A1 * 3/2011 Chaumontet ..... A62B 1/14 188/65.5
2013/0032433 A1 * 2/2013 Codega ..... A62B 1/14 182/5
2014/0196984 A1 * 7/2014 Chabod ..... A63B 29/02 182/18

(Continued)

FOREIGN PATENT DOCUMENTS

EP 0 688 581 A1 12/1995
EP 2 018 894 A1 1/2009
FR 2 721 523 A1 12/1995

*Primary Examiner* — Alvin C Chin-Shue
*Assistant Examiner* — Shiref M Mekhaeil
(74) *Attorney, Agent, or Firm* — Oliff PLC

(57) ABSTRACT

The descender comprises a handle and a cam that are movable between a securing position and a sliding position of the rope. The cam defines a first stop and a second pin. The handle has a first pin coming into contact with the first stop to form a first mechanical link and a second stop coming into contact with the second pin. Movement of the handle results in movement of the cam between the securing and sliding positions. In a threshold position of the handle, the first mechanical link is interrupted and the cam returns to the securing position. The second stop is movable with respect to the handle by means of a spring. When movement of the handle takes place, the second pin comes into contact with the second stop before the handle stresses a spring and reaches the threshold position.

9 Claims, 8 Drawing Sheets

(56) References Cited

U.S. PATENT DOCUMENTS

| | | | | |
|---|---|---|---|---|
| 2015/0183624 | A1* | 7/2015 | Maurice | B66D 3/046 254/399 |
| 2016/0228730 | A1* | 8/2016 | Chaumontet | A63B 29/02 |
| 2016/0287913 | A1* | 10/2016 | Bell | A62B 1/14 |
| 2018/0154190 | A1* | 6/2018 | Chabod | A62B 1/14 |
| 2019/0351264 | A1* | 11/2019 | Ratalino | A62B 1/14 |
| 2020/0031638 | A1* | 1/2020 | Chabod | A62B 1/14 |

* cited by examiner

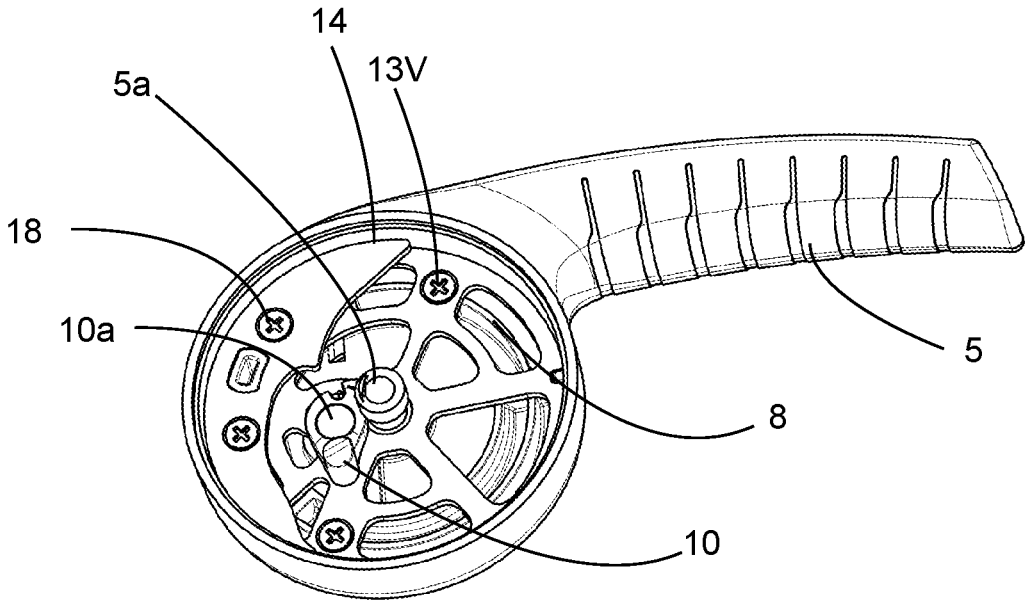
Fig. 3
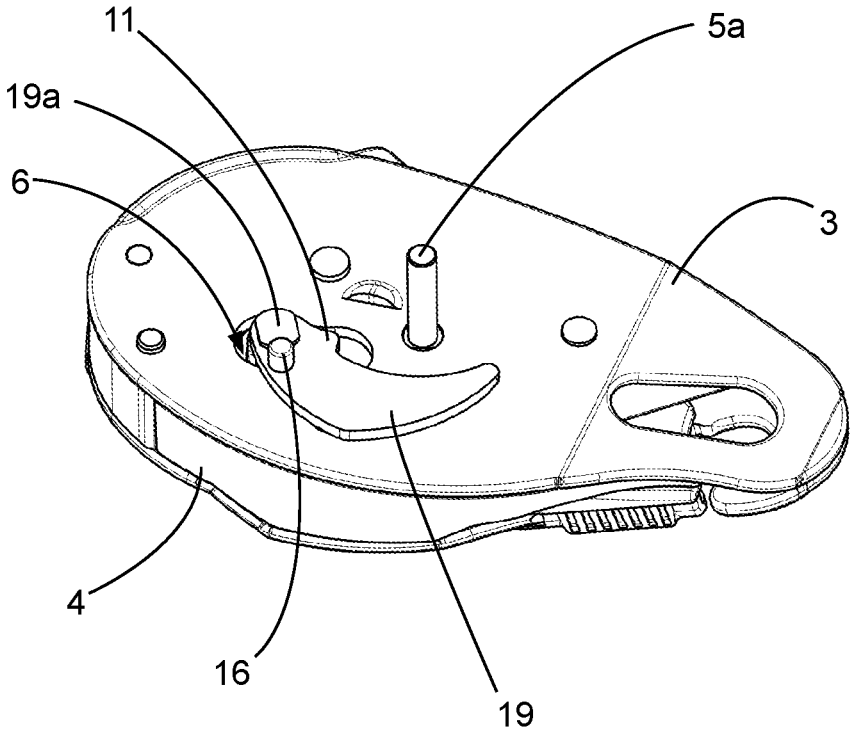

SELF-LOCKING DESCENDER WITH DISENGAGEABLE HANDLE

FIELD OF THE INVENTION

The invention relates to a self-locking descender for descending along a rope.

STATE OF THE ART

The document EP 688,581 filed by the applicant describes a descender of the kind mentioned in which the manual actuating handle is connected to the pulley by a mechanical link with a toggle-joint. Descending movement of the user is enabled when the handle is moved to an intermediate position in which the cam is released. Double securing of the rope is possible in the loaded state for two distinct positions of the handle:

either a raised position after the handle has been released, or after disengagement of the mechanical link when the handle is lowered beyond the intermediate position.

After disengagement, the mechanism has to be reset to re-establish the mechanical link. The disengagement threshold depends on the angular position of the handle and on the force to be exerted depending on the load applied on the apparatus.

The document EP 2,018,894 describes an improvement of a self-locking descender which is provided with controlled disengagement of the mechanical link between the pulley and the handle. The descender is provided with a function called "anti-panic" function which, when the handle regulating the friction force reaches a threshold position, interrupts the mechanical connection between the handle and the cam resulting in a friction force being exerted against the rope. Once the mechanical connection has been broken, the cam returns to a securing position which blocks the rope and stops the descending movement of the user. The descender can be reset by moving the handle in the opposite direction. The descender also has a button located on the end of the handle that operates in conjunction with a ramp so as to form another mechanical contact between the handle and cam to allow the user to descend when the handle has been moved beyond the threshold position. The anti-panic function is deactivated by pressing on the button.

It has become apparent from use that a large number of users have difficulty in keeping the handle just below the threshold position corresponding to interruption of the mechanical connection between the handle and cam. When descending along a slope with a gentle incline, users may get the impression that interruption of the mechanical link between the handle and cam takes place too early. The users would then deactivate the anti-panic function by pressing continuously on the button throughout the descent. The advantage of the function is then negated and the risk of an accident is increased as having to press continuously on the button may make the user tense up.

OBJECT OF THE INVENTION

One object of the invention consists in providing a self-locking descender with controlled disengagement of the mechanical link between the cam and handle, disengagement being performed in automatic manner while informing the user that the handle is close to the threshold position.

The descender according to the invention is remarkable in that it comprises:

a cam movable between a first position designed to block a rope and a second position designed to allow sliding of the rope, the cam defining a first stop, a handle fitted movable at least in a first direction of movement, the handle having a first pin arranged to come into contact with the first stop of the cam and to form a first mechanical link.

The first pin and first stop are arranged in such a way that:

a first movement of the handle in the first direction of movement results in movement of the cam from the first position to the second position, and when the handle reaches a threshold position in the first direction of movement, the first mechanical link is interrupted and the cam returns to the first position.

The descender also comprises:

a second pin fitted on the cam, a second stop fixed to the handle to operate in conjunction with the second pin, the second stop being movable with respect to the handle by means of a spring moving the second stop to a first position.

The second pin and second stop are arranged in such a way that, when the first movement of the handle takes place in the first direction of movement, the second pin comes into contact with the second stop before the handle stresses the spring and reaches the threshold position.

According to a preferential embodiment, the second pin and second stop are arranged in such a way that the second pin escapes from the second stop when the handle reaches the threshold position.

In one development, a ramp is fixed to the handle in movable manner, the ramp defining the second stop and the spring connecting the ramp with the handle.

Preferentially, a second ramp is fixed to the cam, the second ramp being fitted movable with respect to the cam and being configured to come into contact with the first pin before the handle reaches the threshold position.

It is particularly advantageous to provide for the first pin to be formed by a rod movable in rotation, the second ramp forcing the rod to swivel to interrupt the first mechanical link and to interrupt the mechanical connection between the second pin and the second stop.

It is a further object of the invention to provide a method for using a descender that is easier to use.

The method is remarkable in that it comprises:

providing a self-locking descender according to one of the foregoing embodiments, with a handle mechanically connected to a cam by means of a first mechanical link, moving the handle in a first direction of movement so that the handle successively defines a first securing position of the rope where the cam blocks the rope, a descent position where the cam allows the rope to slide and a first threshold position where the first mechanical link between the handle and cam is interrupted, the cam returning to the securing position.

The method is also remarkable in that the handle stresses a spring between the descent position and the first threshold position before the threshold position is reached.

Stressing of the spring enables a predefined minimal force to be imposed on the handle so that the user can get a better feeling of approaching the threshold position.

In one development, a second pin is fitted salient on the cam and a ramp is fixed to the handle, the ramp defining a second stop for the second pin, the second stop being movable with respect to the handle by means of a spring moving the second stop to a first position. The second pin and second stop are arranged in such a way that, when the first movement of the handle takes place in the first direction of movement, the second pin comes into contact with the second stop before the handle stresses the spring and reaches the threshold position.

The use of the second pin and second stop means that a second mechanical connection is formed between the cam and handle which makes it easier to define the force to be provided to achieve the minimal force before the threshold position and/or the position of the handle where the spring is stressed.

Preferentially, a second ramp is fixed to the cam, the second ramp being fitted movable with respect to the cam and being configured so as to come into contact with the first pin when movement of the handle takes place in the direction of the threshold position.

In a preferred embodiment, the first pin is swivel-mounted and movement of the handle to the first threshold position forces the first pin to swivel due to the presence of the second ramp.

BRIEF DESCRIPTION OF THE DRAWINGS

Other advantages and features will become more clearly apparent from the following description of an embodiment of the invention, given for non-restrictive example purposes only and represented in the appended drawings, in which:

FIG. 3 schematically illustrates the handle separated from the rest of the descender and in particular from the flanges;

DETAILED DESCRIPTION OF THE INVENTION

Figure 1:
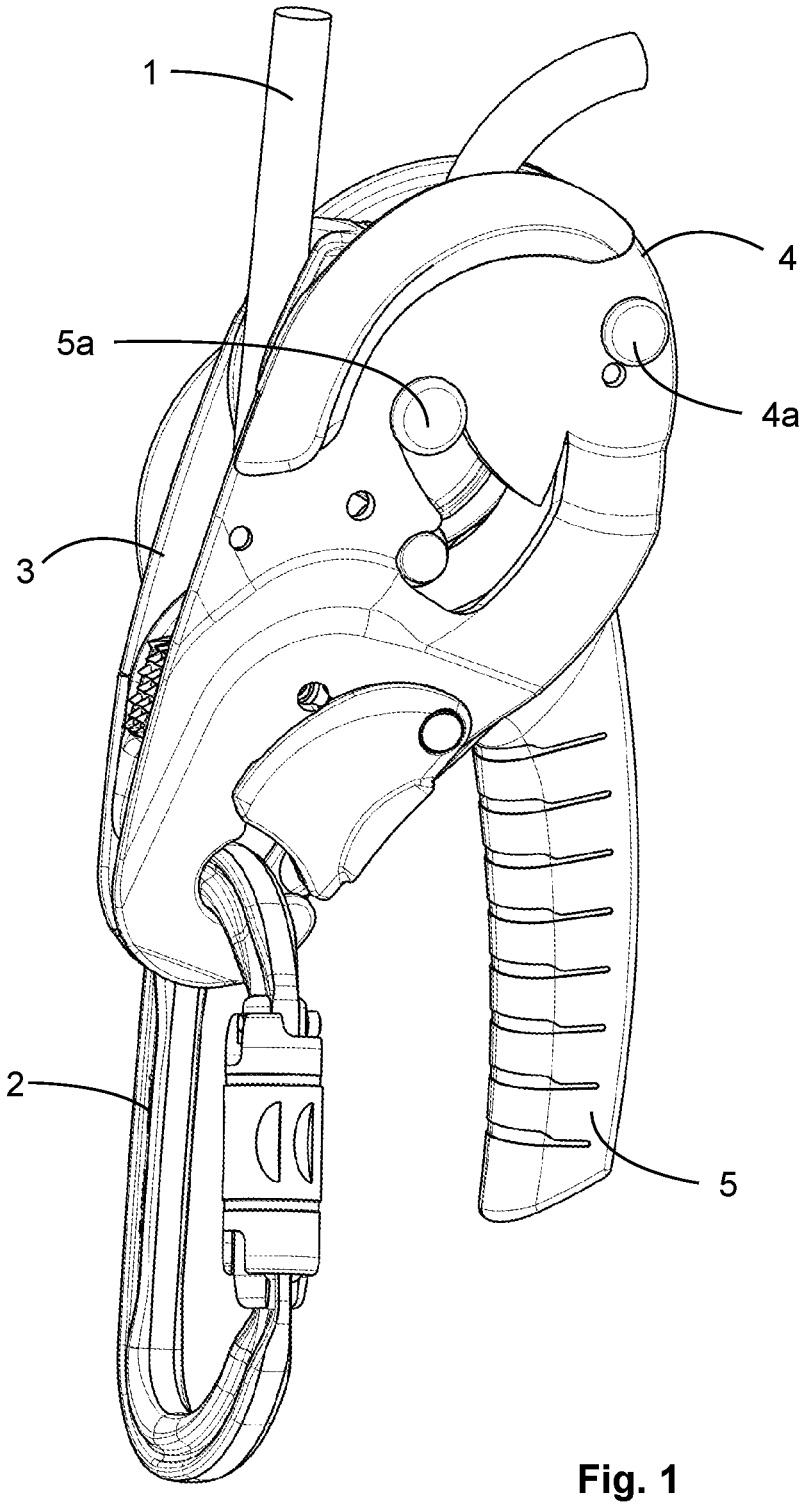
FIG. 1 is a schematic view of the closed descender equipped with a rope and a connector to be attached to the user, the descender being in a securing position of the rope.

FIG. 1 illustrates a self-locking safety descender for descending on a rope 1. The descender is provided with a through-hole designed to operate in conjunction with a connector 2, for example a carabiner, in order to attach the descender to the user and advantageously to attach the descender to a harness worn by the user.

The descender has two inlet/outlet openings that communicate with one another for rope 1 to run inside the descender. In the illustrated embodiment, the descender is provided with a first flange 3 presented as a fixed flange and a second flange 4 presented as a movable flange. In the illustrated example, movable flange 4 is mounted movable in rotation with respect to fixed flange 3 around a swivel-pin 4*a*. Other configurations can be envisaged. First and/or second flanges 3 and 4 can be made from metal, for example from aluminium or aluminium alloy or from steel or from another iron-based alloy. Second flange 4 is advantageously swivel-mounted to enable rope 1 to be easily inserted.

The descender has an actuating handle 5 that is mounted movable, preferably in rotation at least with respect to fixed flange 3. Handle 5 is configured so as to move in a first direction of movement, for example in the counter-clockwise direction or possibly in the clockwise direction. Handle 5 can be mounted movable in rotation around a pivot 5*a*. In the embodiment illustrated in FIG. 1, handle 5 is for example made from plastic or from metal and defines a cavity. Handle 5 possesses an actuating area, i.e. the area where the user will place his hand to control the position of the handle and therefore the friction on the rope 1.

As illustrated in FIGS. 3, 4A, 4B, 5A, 5B, 6A, 6B, 7A, 7B, 8A and 8B, the self-locking descender comprises a first flange 3 and a cam 6 which is mounted on first flange 3. Cam 6 is mounted movable on first flange 3 and preferentially movable in rotation around a swivel-pin 6*a* which facilitates manufacturing of the descender and use of cam 6. However, as an alternative, it is possible to provide for the movement of cam 6 with respect to first flange 3 to be different from a rotation or to comprise a rotation and another movement. In the illustrated embodiment, cam 6 is mounted movable around swivel-pin 2*a*. As illustrated in FIGS. 4B, 5B, 6B, 7B and 8B, first flange 3 defines a running path of the rope by means of a side wall so that the rope runs around cam 6, more precisely between cam 6 and a pad 7 fixed to first flange 3 or formed by the side wall of first flange 3. In advantageous manner, cam 6 is equipped with a groove for rope 1 to run in.

Figure 5A:
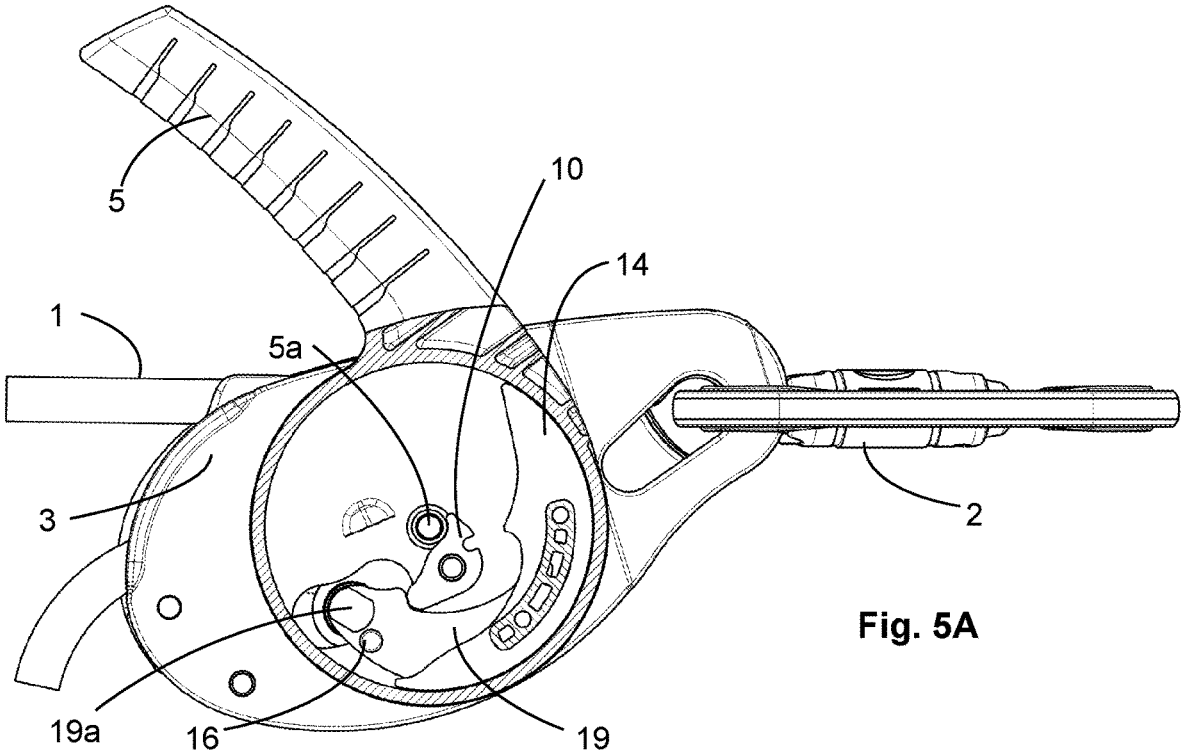
FIGS. 5A and 5B schematically illustrate the position of the different component parts of the descender with respect to one another with a rope fitted in the descender, the handle being mechanically connected to the cam, the cam blocking the rope.
Figure 5B:
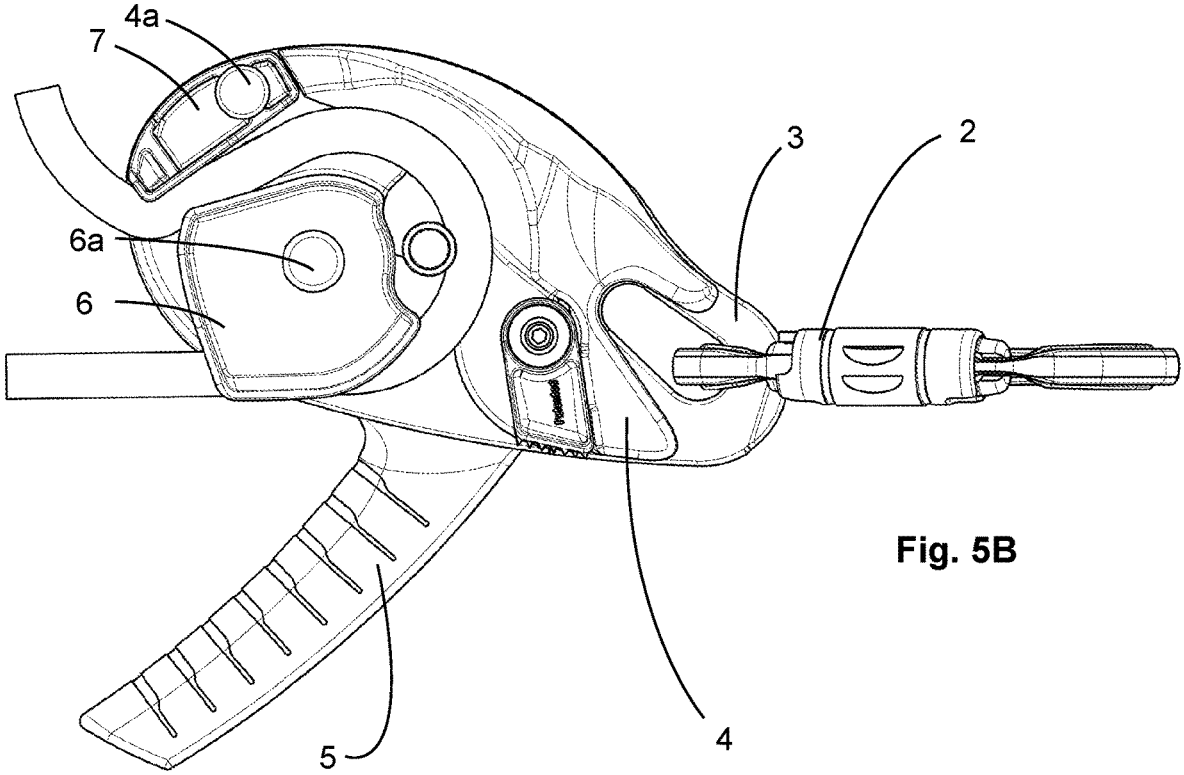
Figure 6A:
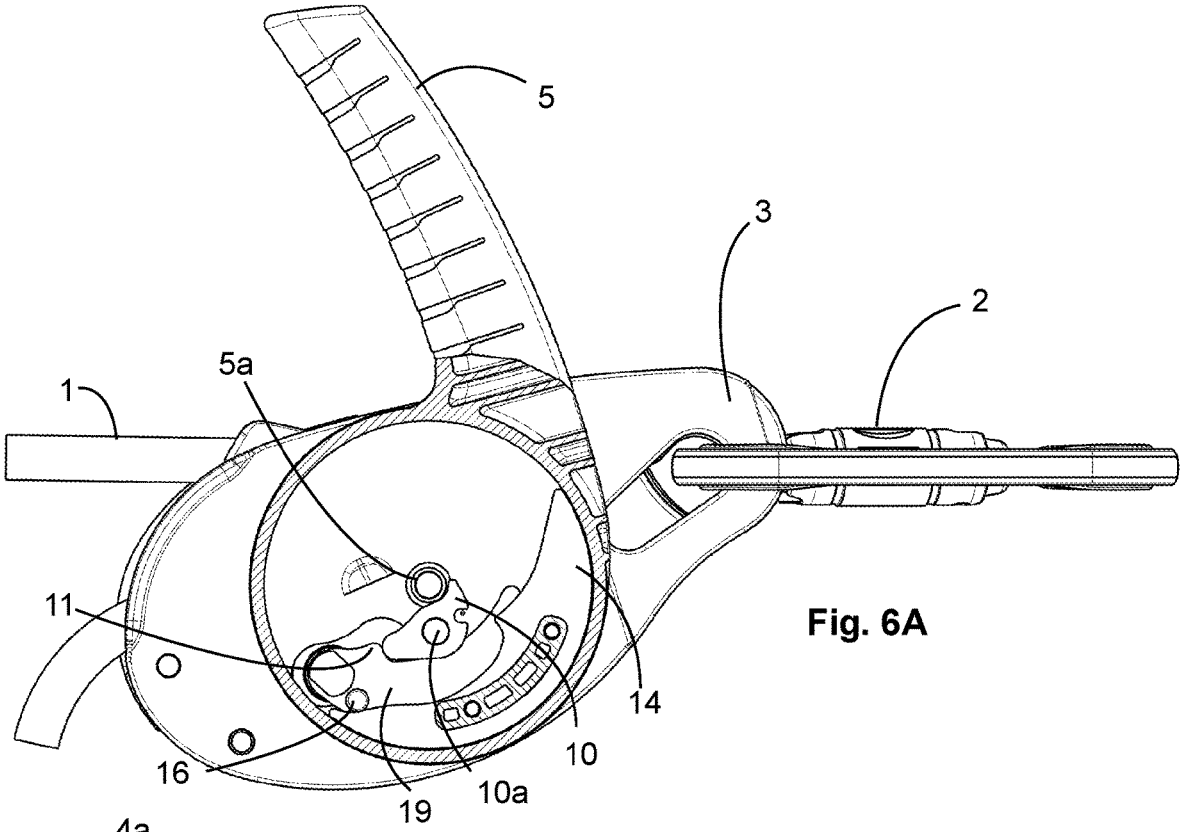
FIGS. 6A and 6B schematically illustrate the position of the different component parts of the descender with respect to one another with a rope fitted in the descender, the handle being mechanically connected to the cam, the cam allowing sliding of the rope.
Figure 6B:
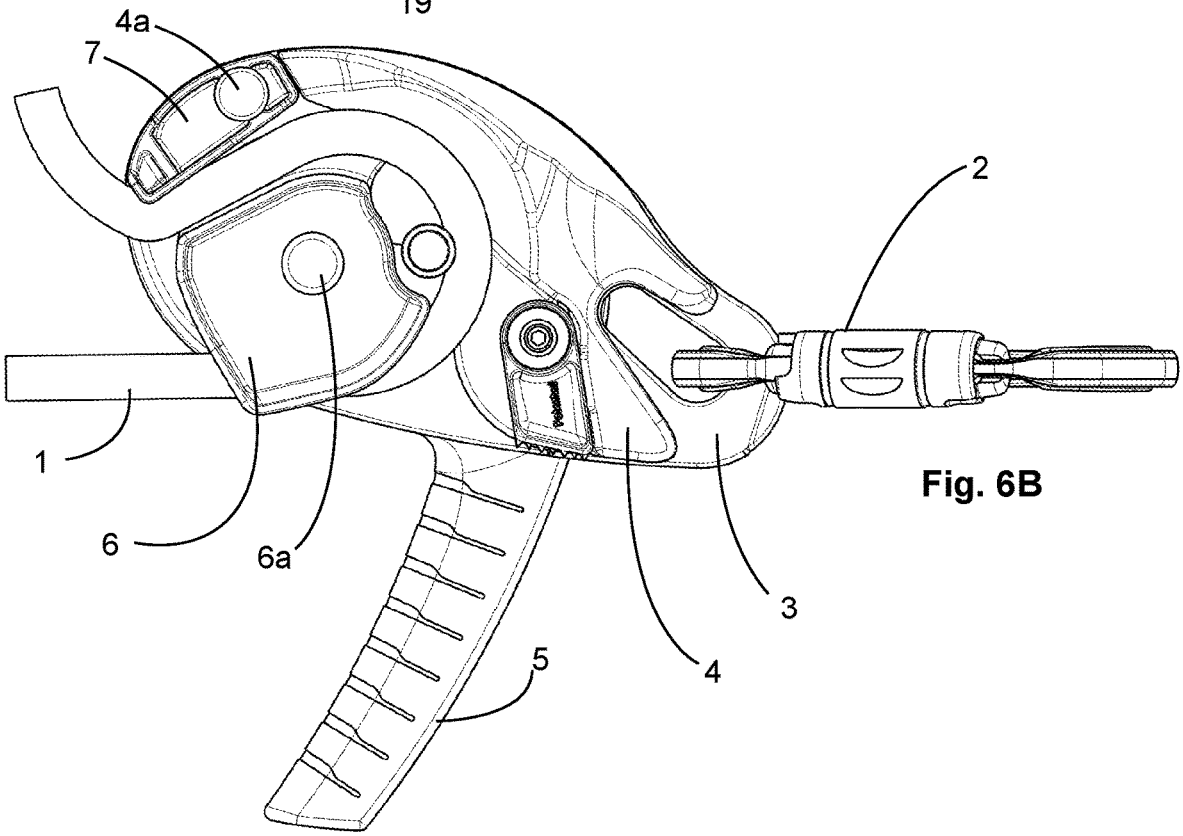

In its movement, cam 6 moves successively between a first position of cam 6 called securing position of the rope (FIGS. 4B and 5B), and a second position of cam 6 called descent position allowing rope 1 to run between pad 7 and cam 6 (FIG. 6B). The first position of cam 6 is a securing position where the distance between cam 6 and pad 7 is such that rope 1 is blocked and cannot slide. In the securing position, the user is attached to rope 1. In advantageous manner, the securing position corresponds to the minimum distance between cam 6 and pad 7.

Movement of handle 5 causes movement of cam 6. Depending on the movement of cam 6, the distance between cam 6 and pad 7 increases or decreases to define the securing position and the intensity of the friction force.

The descent position is a position allowing the user to descend on rope 1 and therefore allowing rope 1 to slide between cam 6 and pad 7. This descent position is illustrated in FIG. 6B.

In the illustrated embodiment, cam 6 is fitted with limited rotation around a first swivel-pin 6*a*, and operates in conjunction with a braking surface of a fixed pad 7 to block or release rope 1. Swivel-pin 6*a* and pad 7 are mounted on first flange 3.

A bias spring can be fitted so as to bias cam 6 to the securing position to facilitate blocking of rope 1. In advantageous manner, the spring can be a torsion spring which is preferentially wound onto swivel-pin 6*a*. In the illustrated example, the descender is not provided with such a spring.

It is advantageous to provide several descent positions of cam 6 allowing rope 1 to run between cam 6 and pad 7, i.e. enabling sliding of rope 1. The different descent positions are associated with different friction forces of cam 6 against rope 1 which represents different bearing pressures of cam 6 against rope 1 that is pressing against pad 7. These different friction forces represent different distances between the side wall of pad 7 and the side wall of cam 6.

In an advantageous embodiment illustrated in FIGS. 5B and 6B, modulation of the intensity of the friction forces is performed in continuous manner by adjusting the shape of the side wall of cam 6 in order to adjust the space that exists between the side wall of cam 6 and the side wall of the running path defined by first flange 3.

The descender is further provided with an interruptible mechanical connector that is configured to form a first mechanical link between actuating handle 5 and cam 6 so that a first movement of handle 5 results in movement of cam 6 from the first position to the second position. This movement is illustrated between FIGS. 5A and 6A and also between FIGS. 5B and 6B.

By means of the first mechanical link between handle 5 and cam 6, movement of handle 5 causes movement of cam 6 enabling cam 6 to move between the securing position and one or more descent positions. When handle 5 moves in the first direction of movement, for example from a standby position where the handle is not stressed, handle 5 moves so as to form the first mechanical link and then causes movement of cam 6 from the securing position to the descent position.

Cam 6 can be self-locking and/or it can be associated with a spring which returns it to the securing position so that movement of handle 5 in a second direction of movement opposite from the first direction of movement results in cam 6 being returned to the securing position by means of the tensioned rope or the spring.

Figure 7A:
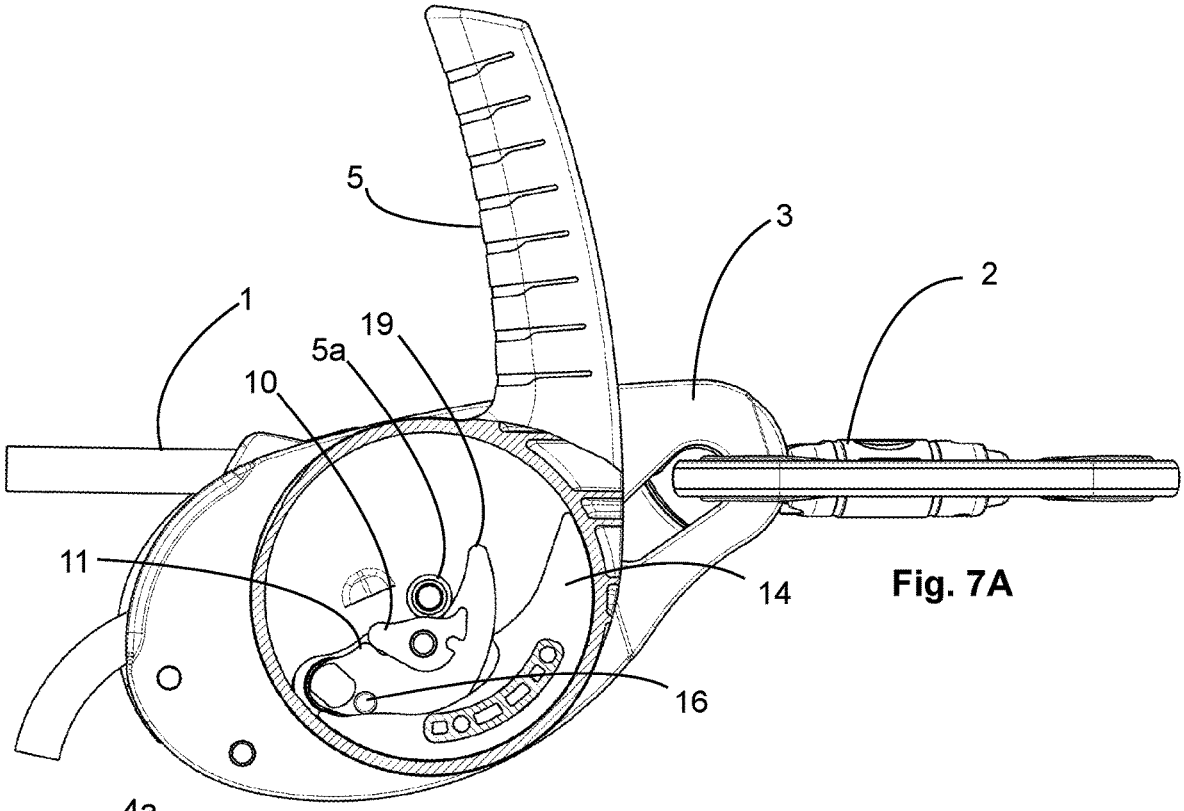
FIGS. 7A and 7B schematically illustrate the position of the different component parts of the descender with respect to one another with a rope fitted in the descender, the handle being in the first threshold position.
Figure 7B:
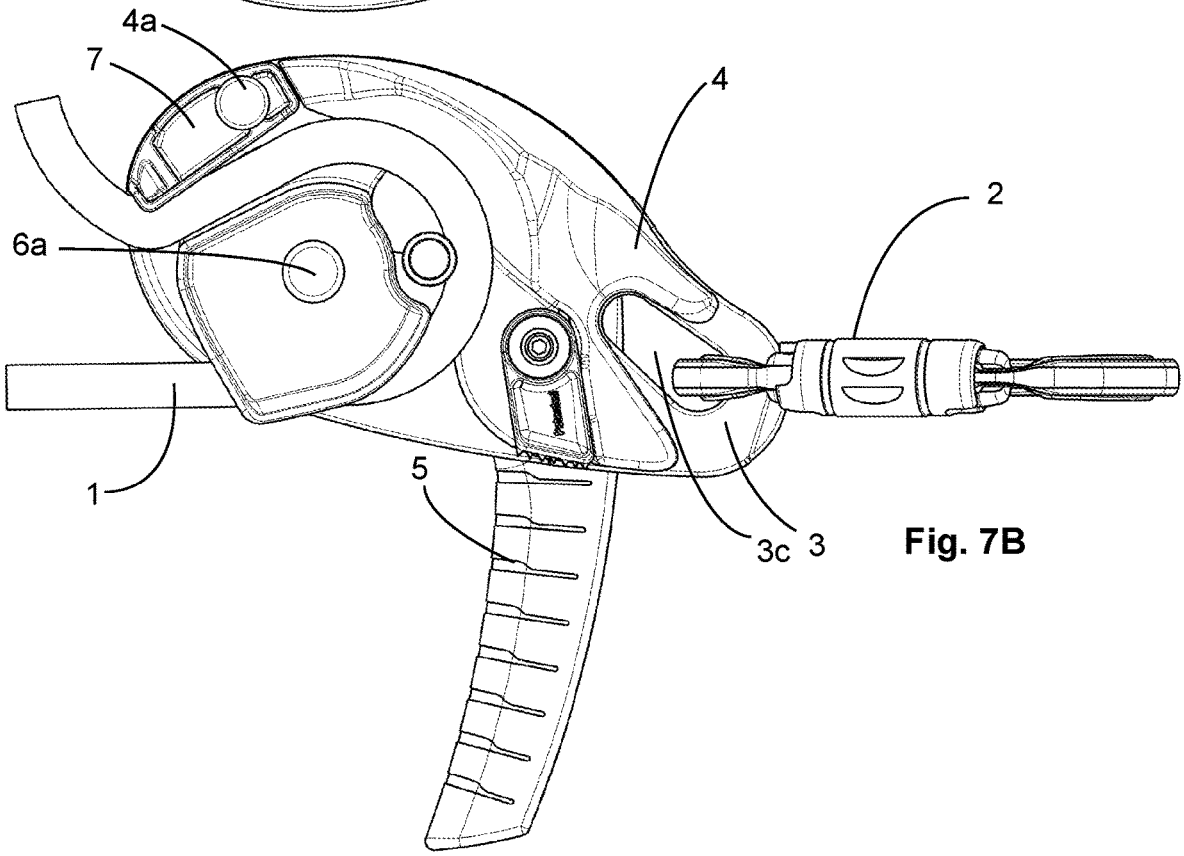

It is also advantageous to provide for the descender to have an "anti-panic" function, i.e. a configuration where the first mechanical link between handle 5 and cam 6 is interrupted when the position of handle 5 moves beyond a threshold position in the course of movement in the first direction of movement. The threshold position is illustrated in FIGS. 7A and 7B.

In other words, the interruptible mechanical connector is configured in such a way that, when handle 5 reaches the threshold position in the first direction of movement, the first mechanical link is broken. As indicated in the foregoing, cam 6 can be configured so as to be self-locking and/or can be associated with a spring so that cam 6 returns to the first position, i.e. it is blocking rope 1.

When movement takes place in the first direction of movement, handle 5 is mounted in movable manner and can successively define a first position that corresponds to blocking of rope 1, a second position where rope 1 slides in the descender and a third position also called first threshold position where the "anti-panic" function is triggered, i.e. where the first mechanical link is interrupted.

In other words, handle 5 is mechanically connected to cam 6 so that movement of handle 5 results in movement of cam 6 to increase the distance between the side wall of cam 6 and the side wall of pad 7. This increase of distance takes place until the position of handle 5 with respect to first flange 3 reaches a threshold position. Once this threshold value has been reached, the first mechanical link is interrupted and cam 6 returns automatically to its securing position. This interruption of the mechanical link advantageously results in a handle 5 that is much easier to operate so that the user is aware that disengagement has taken place.

Advantageously, once the threshold position has been reached, there is no mechanical link between handle 5 and cam 6 so that movement of handle 5 does not have any effect on the position of cam 6 which remains in the securing position at least over a first distance of movement of the handle in the first direction of movement.

When descending, the user observes the surrounding environment so as to control his descent and to progress in complete safety. It is very rare for the user to have his eyes riveted on the descender to know whether handle 5 is close to the threshold position. The inventors observed that users attempt to determine the threshold position according to the speed of descent and therefore indirectly by means of the tension in rope 1. However, when the slope is gentle, the descent is jerky which makes it very difficult to determine the threshold position. This results in the position very often being overshot which makes the descent chaotic with frequent resetting of the descender.

To make the descender easier to use, the inventors propose to form a hard spot just before the threshold position. This hard spot corresponds to a minimum force to be applied on handle 5 to reach the threshold position. It is apparent that creation of this hard spot means that the user can easily know that he is close to the threshold position and is therefore able to avoid interruption of the first mechanical link. This hard spot can be detected by the user without having to look at the descender.

If the user descends along a slope with a gentle incline, the force applied on cam 6 can be low. The user detects the hard spot in handle 5 and can prevent interruption of the first mechanical link by avoiding continuing beyond the threshold position. When performing a purely vertical descent, the additional force introduced by the descender to indicate the threshold position is small in comparison with the force applied by the user on handle 5 to control his descent. This force may even not be noticed and will not prevent the threshold position from being reached.

Different technical solutions can be envisaged to form the hard spot and in particular by reshaping the components defining the first mechanical link so that the user forces on the handle to pass the threshold position. This solution is not satisfactory as it is complicated to implement and may make it more difficult to move beyond the threshold position when the cam is heavily stressed.

The inventors noted that it is particularly advantageous to provide for the additional force to be introduced by means of a second mechanical contact between handle 5 and cam 6 or first flange 3. The second mechanical contact makes it possible not to modify the behaviour of the descender before the threshold position.

Once the first mechanical link has been interrupted, it is advantageous to re-establish the mechanical link by moving handle 5 in a second direction of movement opposite to the first direction of movement until a second threshold position is reached. In advantageous manner, the second threshold position is situated after the first threshold position in the second direction of movement. In this way, the user detects interruption of the mechanical connection and can move handle 5 in the opposite direction to reset the anti-panic function. Advantageously, handle 5 is associated with a spring 8 (FIG. 3) which is configured to move the handle in the second direction of movement to a rest position.

In particularly advantageous manner, when movement of handle 5 takes place in the first direction of movement, the second mechanical contact between the cam and handle is formed and the handle stresses a second spring 9. To stress second spring 9, the user has to exert an additional force which informs him/her that handle 5 is approaching the threshold position.

In order to maintain operation that is substantially compliant with descenders of the prior art and in order to preserve the compactness of the descender, it is particularly advantageous to fit second spring 9 on handle 5.

Figure 2:
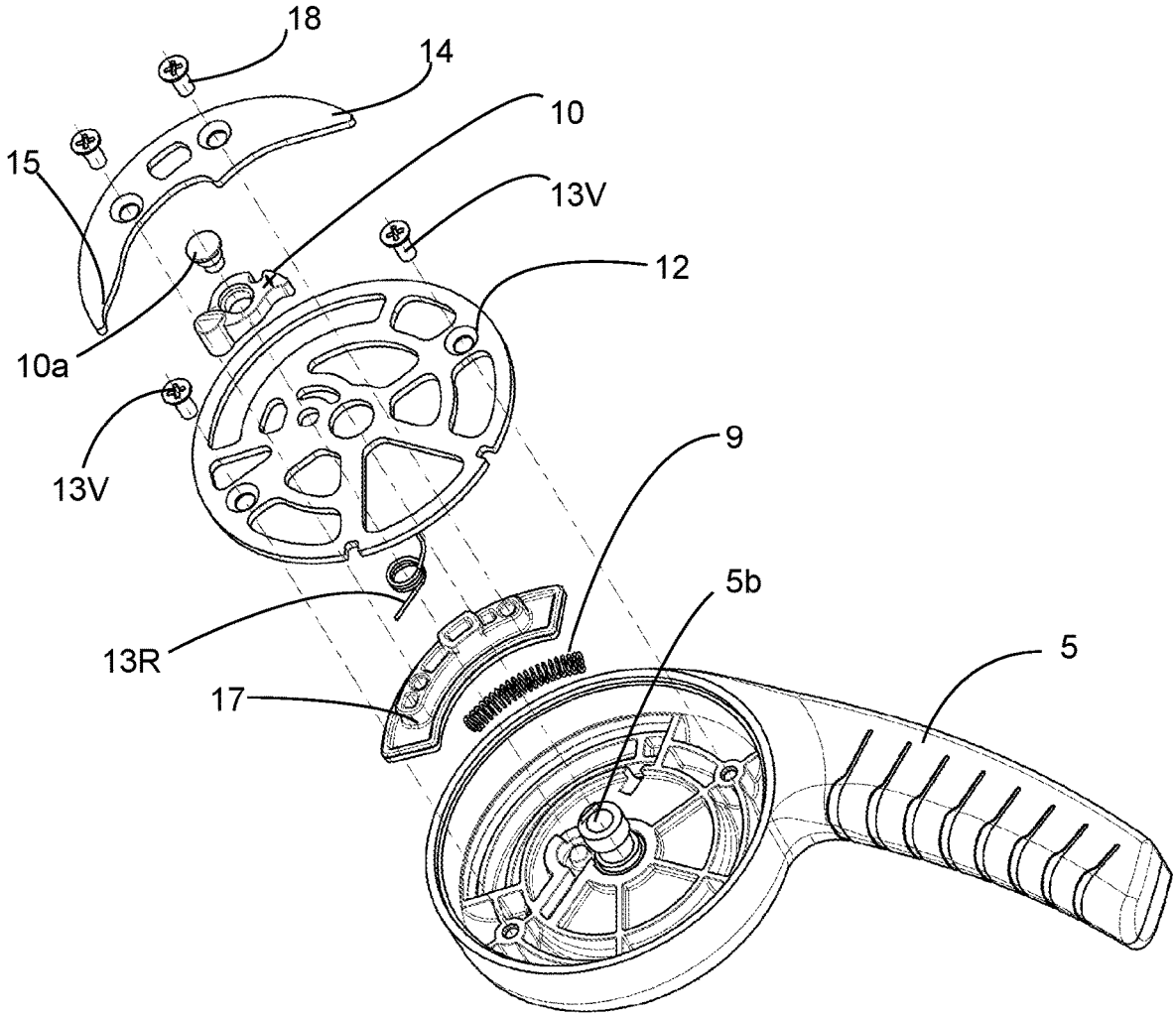
FIG. 2 schematically illustrates an exploded view of a handle according to the invention.
Figure 4A:
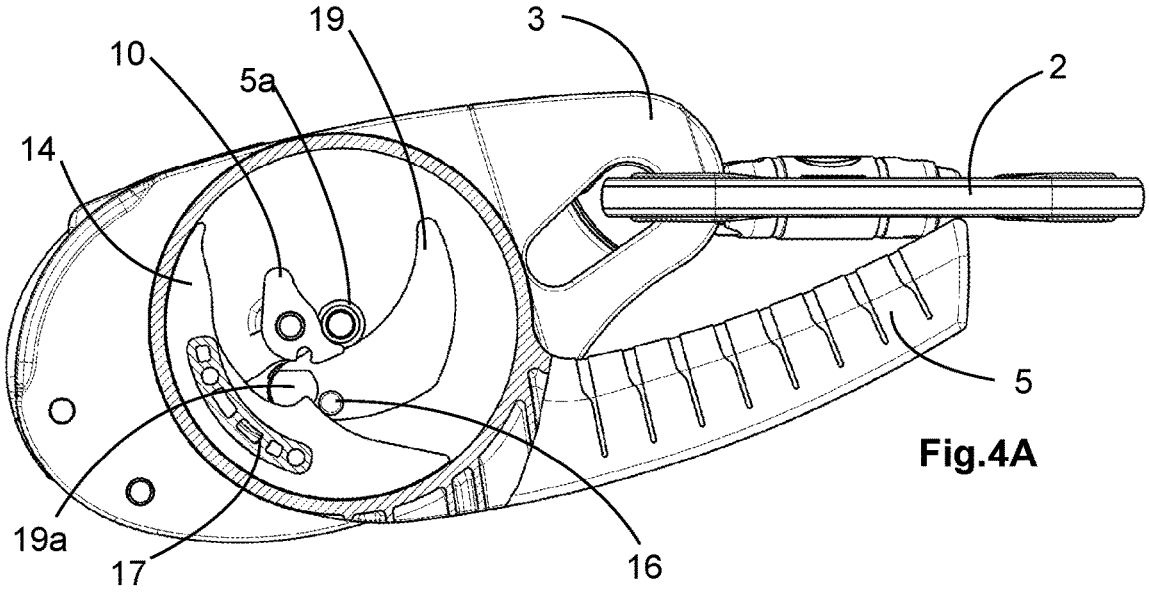
FIGS. 4A and 4B schematically illustrate the position of the different component parts of the descender with respect to one another when no rope is present in the descender, the handle being in the standby position.
Figure 4B:
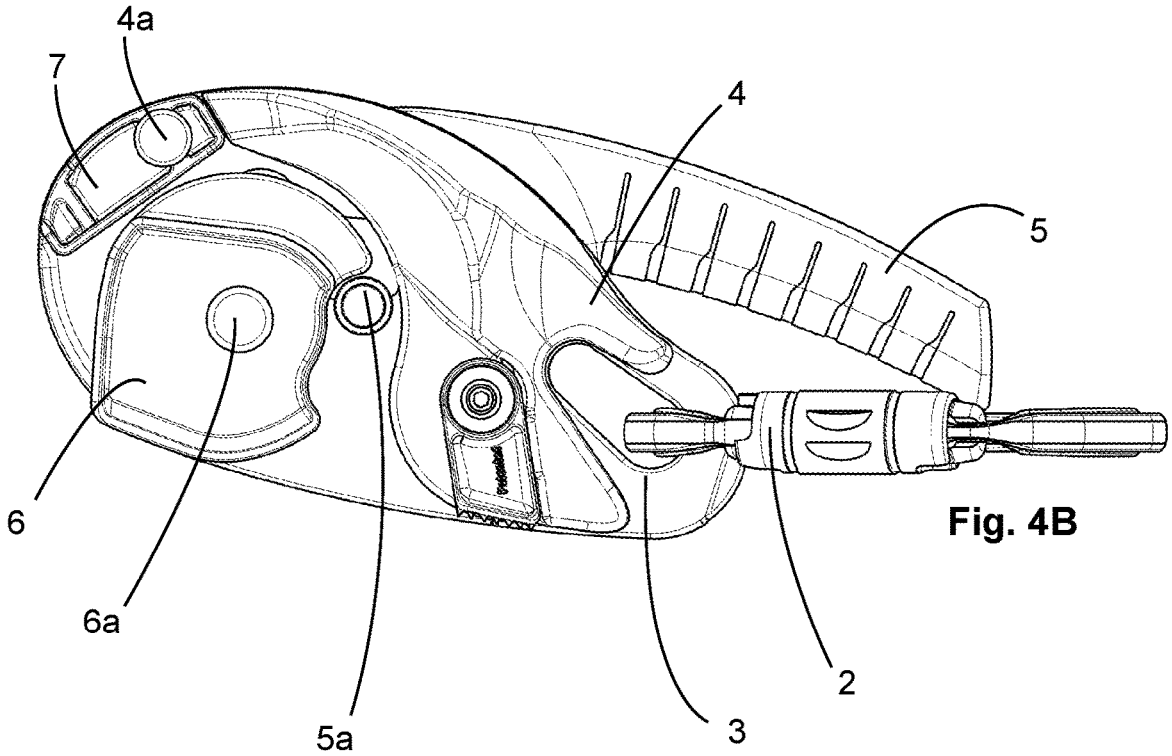

In the particular embodiment illustrated in FIG. 2, handle 5 forms a first cavity 5*b* designed to operate in conjunction with a swivel-pin 5*a* salient from first flange 3 to define swivel-pin 5*a*.

Handle 5 also has a first pin 10 arranged to operate in conjunction with a first stop 11 of cam 6. Handle 5 and cam 6 are configured so that first pin 10 and first stop 11 form the first mechanical link and first pin 10 slides along the stop so that, when handle 5 reaches the threshold position, first pin 10 moves away from stop 11 to interrupt the first mechanical link.

In advantageous manner, first pin 10 is mounted fixed on a plate 12 itself mounted fixed to handle 5. Plate 12 is for example fixed to the handle by means of one or more screws 13V, but other securing means can be envisaged.

In advantageous manner, first pin 10 is formed by a first rotary rod. This first rod 10 is fixed to handle 5. First rod 10 is fitted movable with respect to handle 5, for example by rotation by means of a swivel-pin 10*a* fixed to handle 5. The first rod comes into contact with cam 6 to form the first mechanical link so that movement of handle 5 results in movement of the rod which causes movement of cam 6. In the illustrated example, first rod 10 is fixed to the plate by means of its swivel-pin 10*a*. First rod 10 is associated with a third spring 13R configured to return first rod 10 to a rest position (FIG. 2).

Rotation of the first rod enables the first mechanical link to be reset by facilitating return of first pin 10 to a position facing first stop 11 after movement of handle 5 in the second direction of movement.

A ramp 14 is fitted on handle 5. Ramp 14 defines a second stop 15 designed to come into contact with a second pin 16 of cam 6 to form the second mechanical link between handle 5 and cam 6 enabling spring 9 to be stressed.

Spring 9 is fitted so as to move ramp 14 to a rest position. When movement of the handle takes place in the first direction of movement, the second stop moves from the rest position, as does the ramp, and stresses spring 9 which means that the user has to apply a force on handle 5. The second mechanical link between handle 5 and cam 6 is created before handle 5 reaches the threshold position. Spring 9 is stressed by handle 5 before handle 5 reaches the threshold position.

In the embodiment illustrated in FIG. 2, ramp 14 is fixed to a support 17 by means of one or more screws 18. Support 17 operates in conjunction with plate 12 which defines a guide ensuring controlled movement in the ramp as spring 9 is progressively deformed.

When movement of handle 5 takes place in the first direction of movement, cam 6 comes into contact with ramp 14 and engages second stop 15, for example in the form of a protrusion, just before the threshold position. Second stop 15 can be formed by a protrusion or by any other change of incline or shape enabling cam 6 to slide and then escape. However, it is also possible to provide for cam 6 to remain in contact with ramp 14 after handle 5 has reached the threshold position.

To continue movement of handle 5 in the first direction of movement, handle 5 has to counteract the force applied by rope 1 on cam 6 and also the force applied by spring 9. Spring 9 opposes movement of handle 5 in the first direction of movement and defines a force to be overcome. This force can be felt by the user who can thereby deduce that he is close to the threshold position of handle 5.

In the advantageous embodiment illustrated in FIGS. 6A and 7A, ramp 14 is fitted movable inside a guide enabling movement of the latter to be defined. In the illustrated example, the movement is curvilinear and is substantially in the form of an arc of a circle around swivel-pin 5*a* of handle 5.

In the example illustrated in FIGS. 6A and 7A, ramp 14 operates in conjunction with second pin 16 fitted on cam 6 so that pin 16 slides along the ramp during the first movement of handle 5 until it comes up against stop 15 of ramp 14.

When the movement of handle 5 illustrated in FIGS. 5A and 6A takes place, second pin 16 moves and comes into contact with second stop 15. Second pin 16 moves second stop 15 when rotation of the handle takes place as illustrated in FIGS. 6A and 7A. Second pin 16 slides on second stop 15 at the same time as first pin 10 slides on first stop 11. Once the threshold position has been reached as illustrated in FIG. 7A, second pin 16 slides on second stop 15 and escapes from ramp 14. Simultaneously or almost simultaneously, first pin 10 escapes from first stop 11.

Figure 8A:
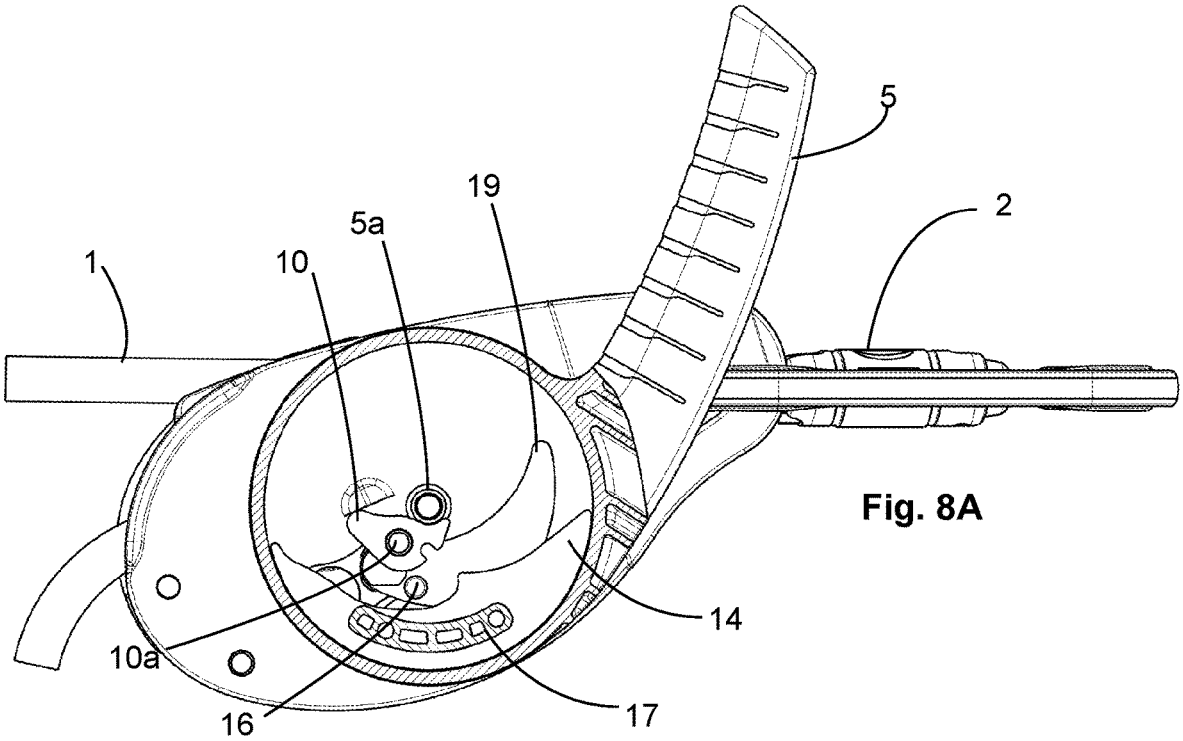
FIGS. 8A and 8B schematically illustrate the position of the different component parts of the descender with respect to one another with a rope fitted in the descender, the handle being located beyond the first threshold position, and the cam blocking the rope.
Figure 8B:
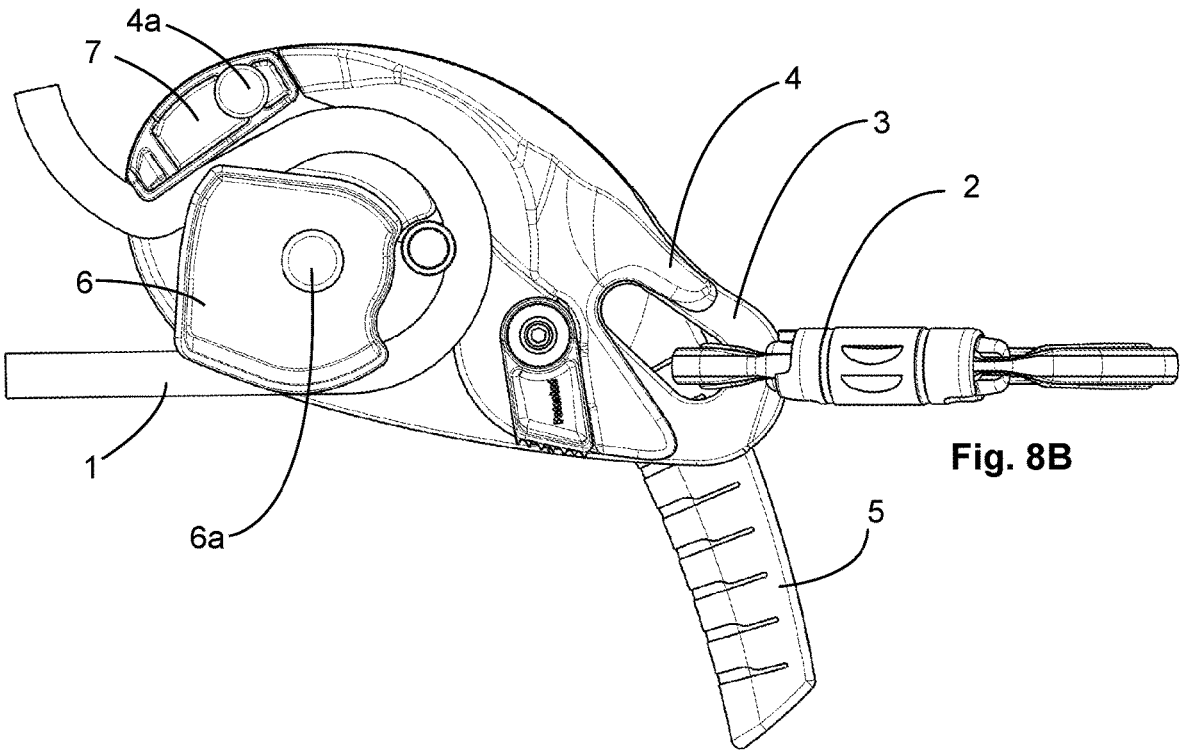

FIGS. 5A and 6A consequently show movement of cam 6 with respect to pad 7 caused by handle 5 which induces sliding of rope 1. Once the threshold position has been reached (FIG. 7A), the first mechanical link is interrupted and the cam will return to the securing position as illustrated in FIG. 8A. FIG. 8B shows that movement of handle 5 in the first direction of movement beyond the threshold position does not enable a new mechanical link to be formed between handle 5 and cam 6.

It is advantageous to provide for first stop 11 and first pin 10 to be arranged in such a way that the first mechanical link is interrupted for the same position of handle 5 as the second mechanical connection between second pin 16 and second stop 15. In simultaneous or almost simultaneous manner, the two mechanical connections between handle 5 and cam 6 are interrupted, which results in handle 5 being easier to move with respect to cam 6 thereby informing the user that the threshold position has been reached.

In particularly advantageous manner, cam 6 has a second ramp 19 above which second pin 16 is located. Second ramp 19 is configured to define first stop 11 and thus to come into contact with first pin 10. In a preferential embodiment, second ramp 19 is fitted movable in rotation with respect to cam 6 around a swivel-pin 19*a*.

Second ramp 19 is fitted movable with respect to cam 6 so that movement of pin 16 causes movement of cam 6. The second ramp defines stop 11 forming the first mechanical link between handle 5 and cam 6 and movable with respect to cam 6.

In a particular embodiment, rotation of handle 5 in the first direction of movement causes pin 10 fixed to handle 5 to be brought into contact with stop 11 of cam 6 to form the first mechanical link and causes movement of cam 6 to a sliding position of rope 1.

Then, before the threshold position is reached, ramp 14 fixed to handle 5 comes into contact with second pin 16 salient from cam 6. The force applied on handle 5 to move in the first direction of movement causes rotation of second ramp 19 in contact with first pin 10, which has the effect of forcing rotation of first rod and of interrupting the mechanical connection between handle 5 and cam 6.

Second pin 16 is arranged at a distance from swivel-pin 19*a* so as to force ramp 19 to rotate. The use of a movable ramp 19 facilitates release of first pin 10 from first stop 11.

In the illustrated configuration, when a purely vertical descent is involved, the force applied by spring 9 is small in comparison with the friction procured by rope 1 so that the additional force procured by the spring before interruption of the first mechanical link takes place is small. Operation of the descender is close to that of the prior art. However, when descending on a gentle slope, the additional force procured by spring 9 on the other hand enables a hard spot to be defined at the level of handle 5, which makes it easier for the user to find the position of handle 5 just before the first mechanical link is interrupted.

The invention claimed is:

1. A self-locking descender for a rope, comprising:

a first flange, a handle having a first pin, a cam movable with respect to the first flange between a first cam position designed to block the rope, and a second cam position designed to allow sliding of the rope, a first stop roatable on a second pin, a second stop mounted on the handle, the second stop being mounted movable with respect to the handle, a spring connected to the handle and to the second stop to resist movement of the second stop with respect to the handle, the second pin mounted on the cam, wherein the handle is mounted movable with respect to the first flange at least in a first direction of movement between a first handle position and a second handle position, the first pin escaping from the first stop when the handle is in a threshold position located between the first handle position and the second handle position, and wherein the second pin contacts the second stop and stresses the spring when the handle is in a third position located between the first handle position and the threshold position, the second pin not stressing the spring when the handle is in the first handle position.

2. The self-locking descender according to claim 1, wherein the second pin escapes from the second stop when the handle is in the threshold position.

3. The self-locking descender according to claim 1, wherein a first ramp is fixed to the handle in movable manner, the first ramp defining the second stop and the spring connecting the first ramp with the handle.

4. The self-locking descender according to claim 1, wherein a second ramp is fixed to the cam, the second ramp is mounted movable with respect to the cam and is configured to contact the first pin when the handle is in an intermediate position between the threshold position and the first handle position.

5. The self-locking descender according to claim 4, wherein the first pin is formed by a rod movable in rotation, the second ramp forcing rotation of the rod to interrupt a first mechanical link and to interrupt a mechanical connection between the second pin and second stop.

6. A method for using the self-locking descender of claim 1 comprising:

providing the rope and the self-locking descender, the self-locking descender comprising the first flange, the handle fitted movable with respect to the first flange in the first direction of movement, the cam designed to block the rope and being movable between the first cam position securing the rope and the second cam position allowing sliding of the rope, the handle being mechanically connected to the cam by the first pin, moving the handle in a first movement in the first direction of movement so that the handle successively defines the first handle position of the rope where the cam blocks the rope, the second handle position where the cam allows sliding of the rope and the threshold position where the first mechanical connection between the handle and the cam is interrupted, the cam returning to the securing position, wherein during the first movement, the handle defines an additional mechanical connection which stresses the spring before reaching the threshold position.

7. The method according to claim 6, wherein a second pin is fitted salient from the cam and the ramp is fixed to the handle, the ramp defining the second stop for the second pin, the second stop being movable with respect to the handle by means of the spring moving the second stop to a first position, and wherein the second pin and second stop are arranged in such a way that, when the first movement of the handle takes place in the first direction of movement, the second pin comes into contact with the second stop before the handle stresses the spring and reaches the threshold position.

8. The method according to claim 7, wherein a second ramp is fixed to the cam, the second ramp being fitted movable with respect to the cam and being configured so as to come into contact with the first pin when movement of the handle takes place in the direction of the threshold position.

9. The method according to claim 8, wherein the first pin is swivel-mounted and movement of the handle to the first threshold position forces swivelling of the first pin by means of the second ramp.

* * * * *